United States Patent [19]

Yamashita et al.

[11] 4,342,282

[45] Aug. 3, 1982

[54] TONER CARTRIDGE

[75] Inventors: Keitaro Yamashita, Kamisatomachi; Toshio Kumakura, Omiya, both of Japan

[73] Assignee: Hitachi Metals, Ltd., Japan

[21] Appl. No.: 288,342

[22] Filed: Jul. 30, 1981

[30] Foreign Application Priority Data

May 7, 1980 [JP] Japan ..... 55-60402

[51] Int. Cl.[3] ..... G03G 15/09

[52] U.S. Cl. ..... 118/657; 118/658

[58] Field of Search ..... 118/657, 658; 355/3 DD

*Primary Examiner*—Bernard D. Pianalto

*Attorney, Agent, or Firm*—Finnegan, Henderson, Farabow, Garrett & Dunner

[57] ABSTRACT

A toner cartridge suitable for use with a developing device of the magnetic brush type using a magnetic toner for an electrostatic recording apparatus including a hollow, cylindrical container closed at opposite ends and formed with a longitudinally extending toner supply opening. The container has a knob at one end and a projection on the outer circumferential surface of the other end. When the cartridge is fitted in a hopper, the projection is inserted in a guide groove formed in an upper portion of the hopper and the cartridge is moved deep into the hopper. Upon completion of fitting, the projection is released from engagement with the guide groove, to allow the container to rotate to feed a charge of magnetic toner from the vessel to the hopper.

2 Claims, 6 Drawing Figures

TONER CARTRIDGE

BACKGROUND OF THE INVENTION

1. Field of the Invention

This invention relates to a toner cartridge assembled with a developing device of electrostatic copying apparatus, facsimile systems, etc., which uses a magnetic toner.

2. Description of the Prior Art

Unlike a two-component developer comprising a mixture of a nonmagnetic toner particle and a ferromagnetic carrier particle, a single component magnetic toner offers advantages in that the developer has only to be replenished during use because it is merely used up and the need to effect carrier replacements due to the fatigue of the carrier is eliminated, and that the need to obtain a mixture of toner particles and carrier particles suitable for producing a uniform toner concentration necessary for achieving frictional charging of the toner particles and carrier particles is eliminated. In view of these advantages, there has in recent years been a tendency to use a single component magnetic toner in place of a two-component developer for developing an electrostatic latent image into a visible toner image in electrostatic copying apparatus, facsimile systems, printers, etc.

FIG. 1 shows one example of developing device using a magnetic toner. As shown, the developing device includes a hopper 1 for a magnetic toner 2, a lid 3 for the hopper 1, and a magnet roll 4 having a magnet 7 secured to a shaft 6 and housed in a nonmagnetic sleeve 5. In operation, the magnet 7 and the nonmagnetic sleeve 6 are rotated relative to each other. For example, the nonmagnetic sleeve 5 is rotated in the direction of an arrow and the magnetic toner 2 is drawn off an outlet 8 and caused to flow in the direction of the arrow over the sleeve 5 to form a magnetic brush which rubs against the surface of a photosensitive member 9 to develop an electrostatic latent image formed thereon into a toner image. When the magnetic toner 2 is supplied to the hopper 1, the lid 3 is manually opened and the magnetic toner is poured into the hopper 1. This operation is troublesome and time consuming because it is necessary to be careful not to spill the toner from the hopper deep into lower parts of the apparatus and to supply the toner in an amount which is more or less uniform for each operation.

Proposals have hitherto been made to use various types of toner cartridges for performing toner supply in one operation without any trouble, as disclosed in Japanese Utility Model Application Laid-Open Number 1246/80, Japanese Patent Application Laid-Open Number 48660/81 and Japanese Patent Application Laid-Open Number 52779/81, for example. Toner cartridges of the prior art have suffered the disadvantages that they are relatively complex in construction and high in cost, and that the structure for receiving the cartridge fitted therein is also complex in construction.

SUMMARY OF THE INVENTION (1) Object of the Invention

This invention has been developed for the purpose of obviating the aforesaid disadvantages of the prior art. Accordingly the invention has as its object the provision of a toner cartridge, simple in construction and requiring a structure of simple construction for receiving the toner cartridge fitted in place, which permits a toner to be supplied positively and readily in one operation.

(2) Statement of the Invention

According to the invention, there is provided a toner cartridge of the type assembled with a developing device using a magnetic toner in the form of a magnetic brush, comprising a hollow cylindrical container closed at opposite ends and formed of a nonmagnetic material, the container being formed with an opening for supplying a toner therethrough into a toner box and having a knob at one end thereof and a projection on an outer peripheral surface of the other end thereof, whereby the container can be fitted in a hopper by causing the projection to move in sliding movement in a guide groove of the hopper and the projection is released from engagement in the guide groove upon completion of fitting of the container in the hopper, to alow the container to move in rotary movement.

DESCRIPTION OF THE PREFERRED EMBODIMENT

Figure 2:
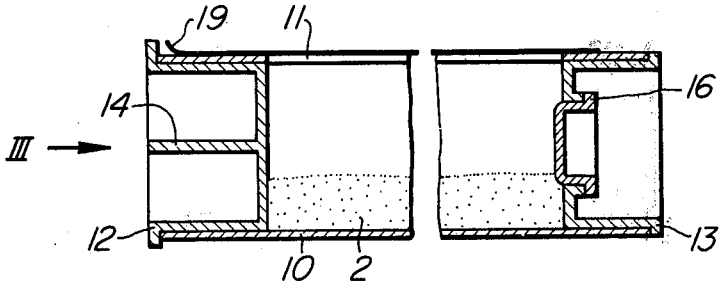
FIG. 2 is a sectional front view of the toner cartridge comprising one embodiment of the invention.
Figure 3:
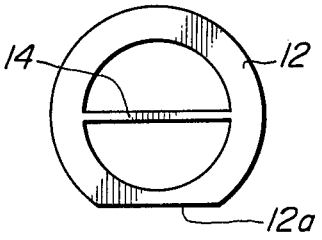
FIG. 3 is a view as seen in the direction of an arrow III in FIG. 2.
Figure 4:
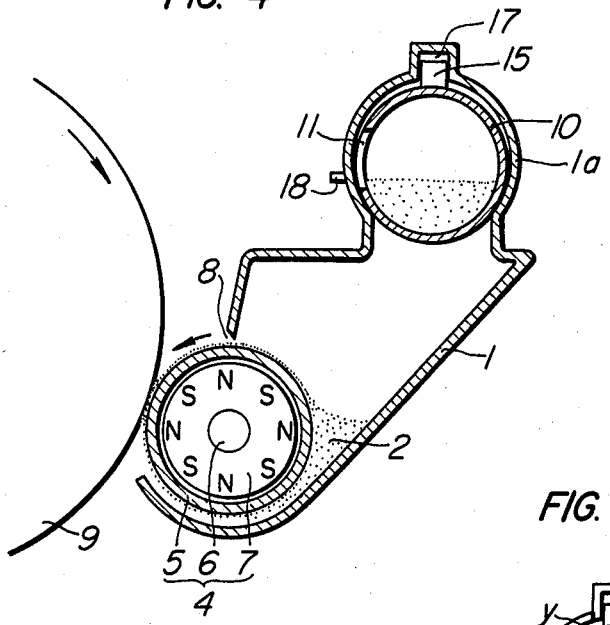
FIGS. 4 and 5 are sectional side view and a plan view of the essential portions, respectively, of a developing device having assembled therewith the toner cartridge shown in FIG. 2.
Figure 6:
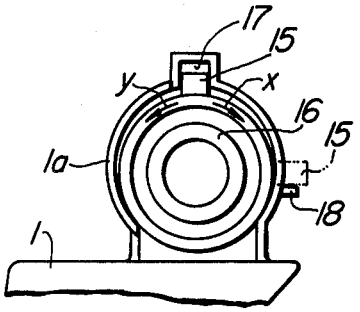
FIG. 6 is a view as seen in the direction of an arrow VI in FIG. 5.
Figure 5:
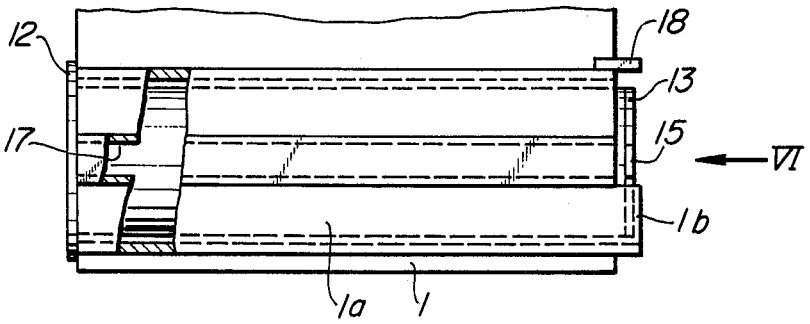

The present invention will now be described in detail by referring to the accompanying drawings showing a preferred embodiment of the invention. FIG. 2 is a sectional front view showing the preferred embodiment of the toner cartridge in conformity with the invention. FIG. 3 is a view as seen in the direction of the arrow III in FIG. 2. FIG. 4 is a sectional side view of the developing device having the toner cartridge according to the invention partially assembled therewith. FIG. 5 is a plan view of the essential portions of the developing device having the toner cartridge wholly assembled therewith. FIG. 6 is a view as seen in the direction of an arrow VI in FIG. 5.

Figure 1:
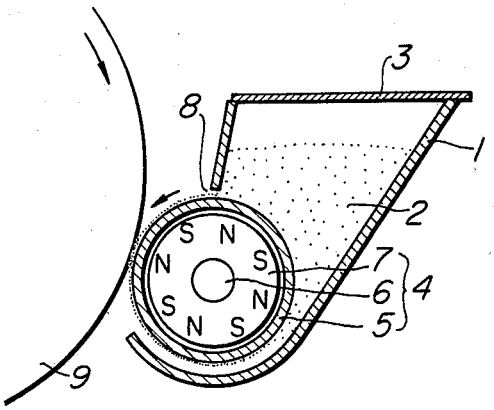
FIG. 1 is a sectional side view of prior art of the developing devices using a magnetic toner.

In FIGS. 3, 4 and 6, parts similar to those shown in FIGS. 1 and 2 are designated by like reference characters.

In FIG. 2, the numeral 10 designates a cylindrical body formed of nonmagnetic material, such as paper, plastics, etc., which is formed with a toner supply opening 11 extending longitudinally thereof and closed by a sealing member 19. The cylindrical body 10 has flanges 12 and 13 each secured to one of its opposite ends to provide a seal thereto. The flange 12 which is formed with a knob 14 has at its end portion a larger outer diameter than the cylindrical body 10, and the flange 13 is formed with a projection 15 (which is not shown in FIG. 2) on its outer circumferential surface. After a charge of magnetic toner 2 is filled in the cylindrical body 10 serving as a cartridge, a cap 16 is fitted to the flange 13. The flange 12 may be advantageously cut out in part to provide a flat portion **12*a* as shown in FIG. 3** which would enalbe the cartridge to be stored on a flat surface without rolling.

The operation of assembling the toner cartridge of the aforesaid construction with a developing device for supplying a toner will be described by referring to FIGS. 3, 5 and 6. The sealing member 19 closing the opening 11 is first removed, and then projection 15 on the flange 13 is inserted in a guide groove 17 formed at the top of a cartridge section 1*a* in an upper portion of a toner box 1 of the developing device and pushed to thereby move the cartridge deep into the cartridge section 1*a*. The guide groove 17 has a length which is such that when the cartridge has moved deep enough in the cartridge section 1*a* to enable the increased diameter end of the flange 12 to abut against the end of the cartridge section 1*a*, the projection 15 is released from engagement in the guide groove 17. Thus after the cartridge has moved to the end of the cartridge section 1*a*, the knob 14 is turned to rotate the cartridge in the direction of an arrow x in FIG. 6, to allow the magnetic toner to be fed through the opening 11 into the toner box 1. To this end, a stopper 18 is provided to the cartridge section 1*a* to be abutted by the projection 15, to cause the carriage to stop rotating as the opening 11 faces downwardly after the cartridge has made substantially ¼ revolution. By forming a projecting edge 1*b* at an extension of the cartridge section 1*a*, it is possible to avoid rotation of the cartridge in the direction of an arrow y in FIG. 6.

When the charge of magnetic toner is contained in the cartridge, the toner supply opening 11 formed in the cartridge should be closed by the sealing member 19 as shown in FIG. 2, to avoid deterioration or cohesion of the toner due to high temperature or high humidity. The sealing member 19 is usually formed of nonmagnetic material capable of providing an airtight seal, such as aluminum foil. The operation of applying the sealing member 19 to the toner supply opening 11 has hitherto been time consuming because the sealing member 19 has been attached to the cartridge by using a bonding agent. The applying of the sealing member 19 can be readily achieved by the following operation. The sealing member 19 which may be formed of transparent plastic sheet, aluminum foil or craft paper lined with silver paper has applied to its undersurface a hot melt agent consisting of wax and the copolymer of ethylene and vinyl acetate, and superposed on the opening 11. When heated at 100°-200° C. for several seconds, the sealing member 19 is firmly attached to the opening 11 in such a manner that it can be readily peeled off.

From the foregoing description, it will be appreciated that the toner cartridge provided by the invention is simple in construction and requires a structure of simple construction for receiving a toner cartridge fitted in place. The toner cartridge according to the invention offers the additional advantages that the operation is simple and that feeding of the toner can be effected in one operation.

What is claimed is:

1. In combination with a developing device using a magnetic toner comprising a hopper for the magnetic toner and a nonmagnetic sleeve having a magnetic roll mounting a plurality of magnetic poles therein, the magnetic roll and the nonmagnetic sleeve rotating relative to each other to draw by magnetic attraction and transport the magnetic toner on the nonmagnetic sleeve, a toner cartridge capable of being detachably fitted in said developing device comprising:

a hollow container of a substantially cylindrical shaped closed at opposite ends;

a toner supply opening formed at an outer circumferential surface of said hollow container to extend longitudinally thereof;

a knob attached to one end of said hollow container;

a projection formed on an outer circumferential surface of the other end of said hollow container, said projection being adapted to be inserted in a guide groove formed in said hopper and extending longitudinally, said guide groove having a length such that when said hollow container is wholly inserted in the hopper by being moved along the guide groove, said projection is released from engagement in the guide groove to allow the hollow container to move in rotary movement; and a stopper for said projection formed at the end of said guide groove to restrict the rotation of said hollow container in a predetermined direction to a range from said toner supply opening to the underside of the container.

2. A toner cartridge as claimed in claim 1, further comprising a sealing member attached by a hot melt agent to said hollow container to provide a seal to said toner supply opening.

* * * * *